US011246427B2

(12) United States Patent
Diep

(10) Patent No.: US 11,246,427 B2
(45) Date of Patent: Feb. 15, 2022

(54) FOLDING WALKER WITH WHEELS

(71) Applicant: Greg Diep, Austin, TX (US)

(72) Inventor: Greg Diep, Austin, TX (US)

( * ) Notice: Subject to any disclaimer, the term of this patent is extended or adjusted under 35 U.S.C. 154(b) by 0 days.

(21) Appl. No.: 16/877,334

(22) Filed: May 18, 2020

(65) Prior Publication Data

US 2021/0127851 A1 May 6, 2021

Related U.S. Application Data

(62) Division of application No. 16/249,809, filed on Jan. 16, 2019, now Pat. No. 10,653,252.

(60) Provisional application No. 62/617,727, filed on Jan. 16, 2018.

(51) Int. Cl.
*A47D 13/04* (2006.01)

(52) U.S. Cl.
CPC ..... *A47D 13/043* (2013.01)

(58) Field of Classification Search
CPC ..... A47D 13/04; A47D 13/043; A47D 1/002
See application file for complete search history.

(56) References Cited

U.S. PATENT DOCUMENTS 517,403 A * 3/1894 Brandish ..... B62K 9/02 280/87.03
4,773,639 A * 9/1988 Graves ..... A47D 13/04 297/5
6,527,285 B1 * 3/2003 Calandro, II ..... A61H 3/04 280/650
8,303,033 B2 * 11/2012 Lundeen ..... A47D 13/107 297/5

* cited by examiner

*Primary Examiner* — Bryan A Evans
(74) *Attorney, Agent, or Firm* — Dean A. Graine, P.S.

(57) ABSTRACT

A child's folding walker with caster wheels that is adjustable in height to permit a child to sit and touch the ground and move the walker. The walker has four vertical legs and two collapsible side frames that enabling the walker to collapse into a vertical configuration. Each collapsing side frame includes a folding upper member and a folding lower member. The proximal ends of the folding members are pivotally attached to a vertical leg. Each upper frame member is made of two elongated sections joined by a locking collar that holds distal ends of the elongated sections together in axial alignment. The locking collar is pivotally attached at its opposite ends to the two elongated sections. When the locking collar is forced upward, the two elongated sections are misaligned thereby enabling the legs to move inward. On the front and rear side frames on the walker is a supplemental locking assembly. The suspension seat is provided for supporting a child.

2 Claims, 6 Drawing Sheets

FOLDING WALKER WITH WHEELS

This is a divisional patent application based on utility patent application (application Ser. No. 16/249,806) filed on Jan. 16, 2019 which is based on and claims the filing date benefit of U.S. provisional patent application (62/617,727) filed on Jan. 16, 2018.

Notice is given that the following patent document contains original material subject to copyright protection. The copyright owner has no objection to the facsimile or digital download reproduction of all or part of the patent document, hot otherwise reserves all copyrights.

BACKGROUND OF THE INVENTION

1. Field of the Invention

This invention pertains to infant walkers, and more particularly, to such walkers that include wheels and collapse for compact storage.

2. Description of the Related Art

Standup play stations for children that include a rigid lower base with four wheels and an elevated platform that supports a child seat are found in the prior art. The elevated platform is held in a fixed elevation above the lower base by four rigid legs. The play station's legs have holes that enable the height of the seat to be adjusted so that the child may sit and still touch the floor and then use his or her feet to move the play station across the floor.

Unfortunately, the standup play stations are rigid structures and not designed to be dissembled or broken down for easy transport in the back of a motor vehicle for use at a remote location, such as a daycare, a park, or a mall.

What is needed is a folding walker with wheels that is adjustable in height that can be easily folded into a compact configuration for easy transport.

SUMMARY OF THE INVENTION

Three embodiments of a folding walker are shown each with wheels that supports the child and is adjustable to permit a child to sit and move the walker. In two embodiments the walker includes a frame that uses four and two X-shaped leg assemblies. In the four leg assembly embodiment, the walker is configured so that the sides collapse inward or horizontally. In the two leg assembly embodiment, the leg assemblies are configured so that the top frame member is pressed downward and vertically collapses on the lower frame member. A third embodiment is disclosed that includes four vertical legs, and an upper platform that attaches to a suspended seat. Disposed between the four legs is a folding support flame configured to hold the four legs in a fixed position when used as a walker but collapses horizontally like the first embodiment into a folded configuration for compact storage and easy transport.

In all three embodiments, the leg assemblies and legs are adjustable in height so that the height of the suspension seat may be adjusted to the height of the child.

DESCRIPTION OF THE PREFERRED EMBODIMENT(S)

Referring to FIGS. 1-18, there is shown a child's folding walker with wheels is adjustable to permit a child to sit and move the walker. There are three embodiments of the walker, 8, 110, and 210 shown and described herein. The first and second embodiments of the walker, 8, 110 uses a frame 8, 112, respectively, that collapse vertically for compact storage. The third embodiment of the walker 210 uses a frame 212, that collapses horizontally for compact storage.

Figure 1:
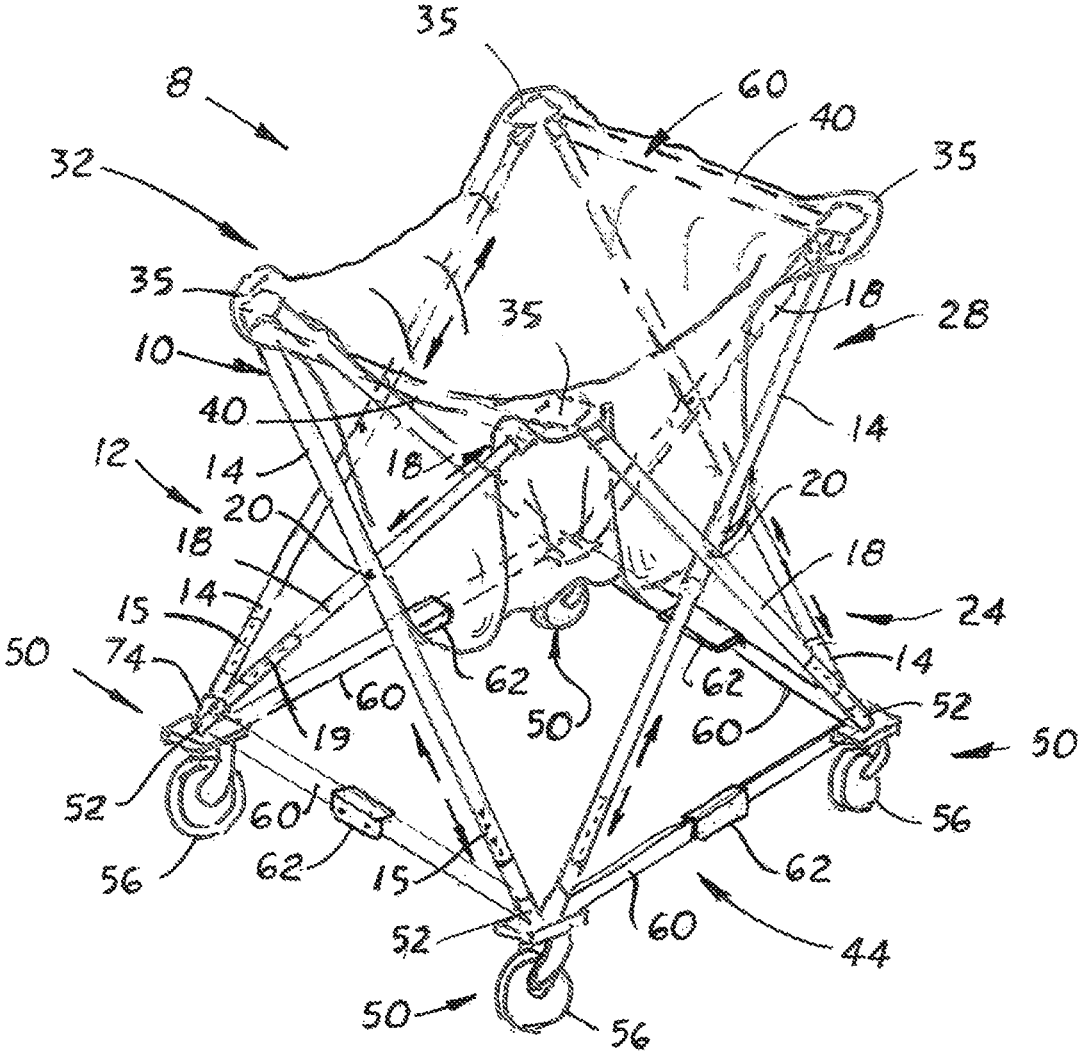
FIG. 1 a perspective view of the first embodiment of the folding walker with wheels that includes four v-shaped leg assemblies with each leg assembly including a caster wheel.
Figure 3:
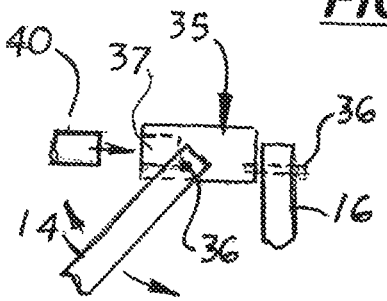
FIG. 3 is a side elevational view of a corner cap being connected to a horizontal support leg, and to a diagonal member on adjacent sides of the walker.
Figure 2:
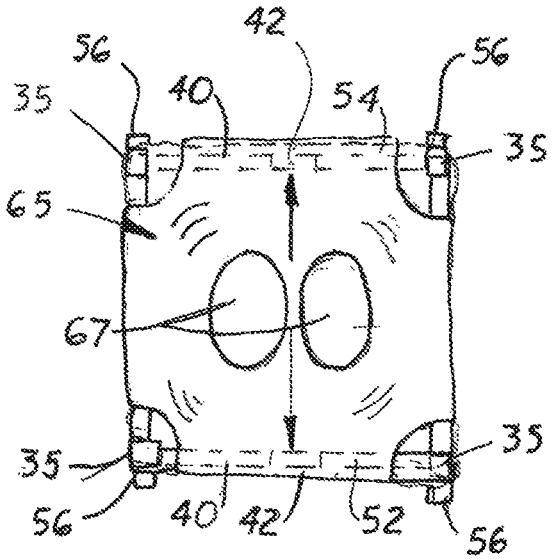
FIG. 2 is a top plan view of the walker shown in FIG. 1.
Figure 4:
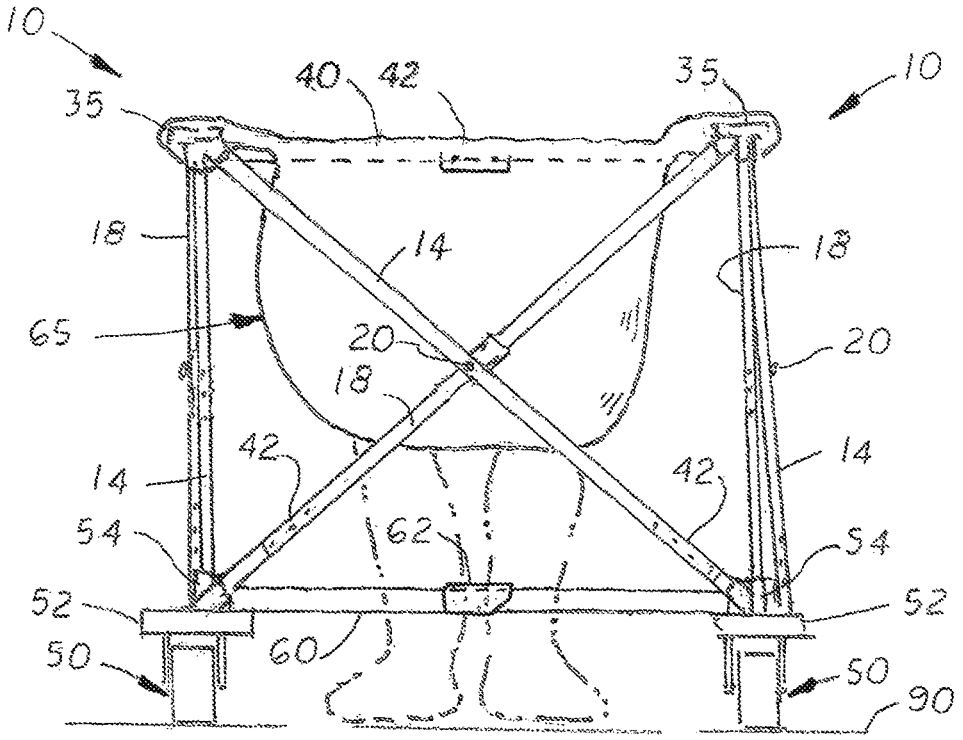
FIG. 4 is a side elevational view of the walker with wheels shown in FIG. 1.
Figure 5:
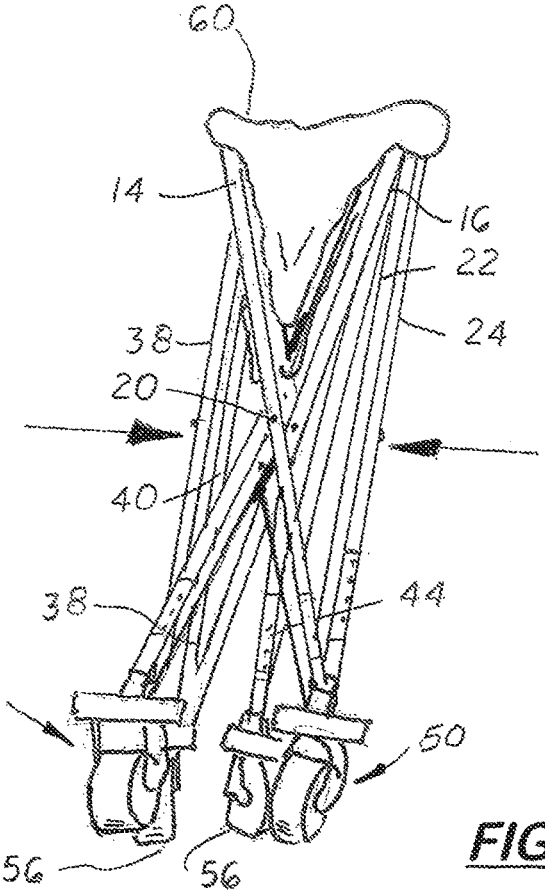
FIG. 5 is a side elevational view of the walker shown in FIG. 1 in a vertically collapsed configuration.
Figure 6:
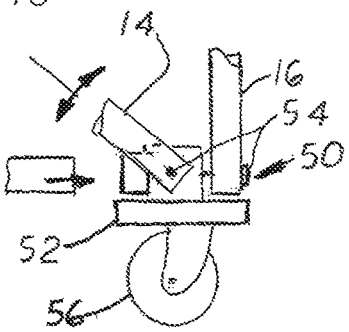
FIG. 6 is a side elevational view of a caster wheel assembly.
Figure 15:
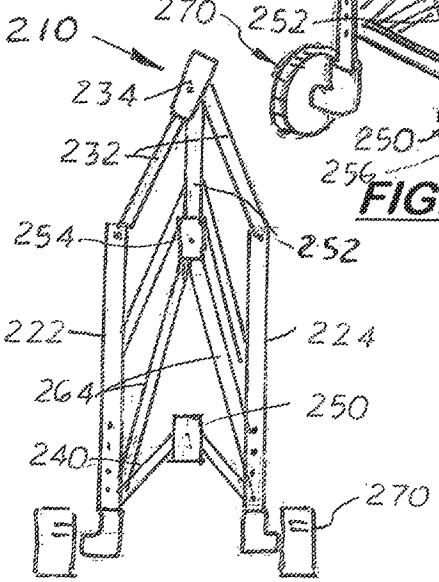
FIG. 15 is a side elevational view of the walker shown 13 in a collapsed configuration.
Figure 17:
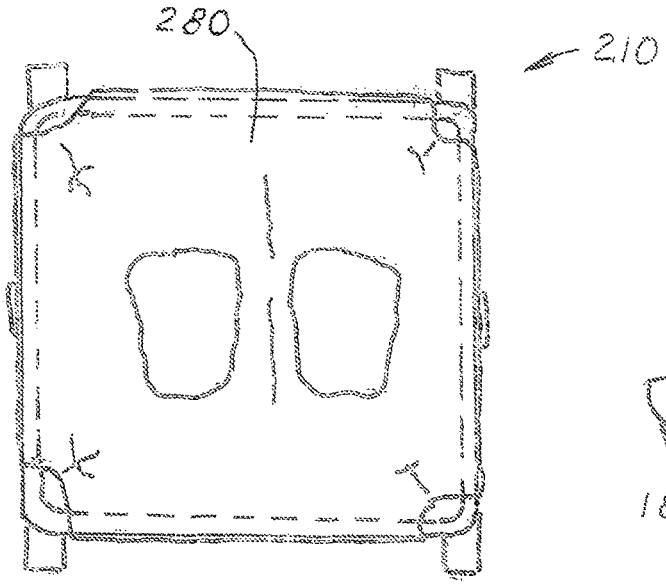
FIG. 17 is a top plan view of the walker shown in FIG. 13.
Figure 18:
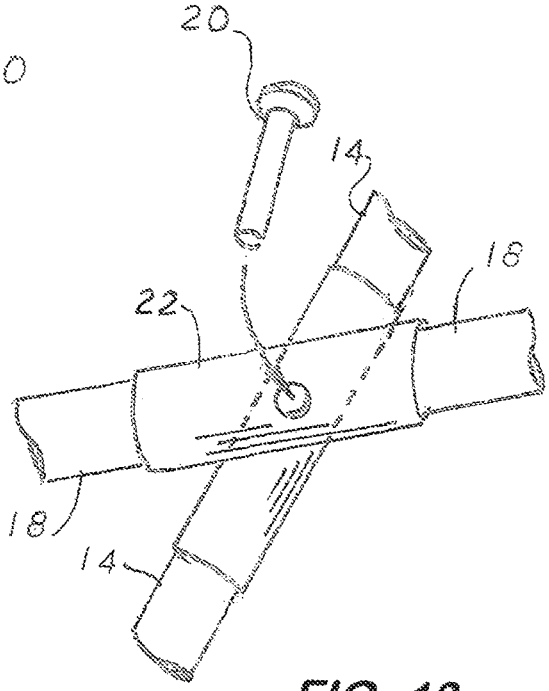
FIG. 18 is a perspective view of a coupler two crossing diagonal legs used in the first and second embodiments of the walker.

In the first embodiment, shown in FIGS. 1-3, the walker 8 uses a four-sided frame 10 that includes a four, collapsible and telescopically adjustable leg assemblies 12, 24, 28, and 32. The leg assemblies 12, 24, 28, and 32 are configured to stand vertically and are approximately 90 degrees apart. Each leg assembly 12, 24, 28 and 32 includes two diagonal frame members 14, 18 pivotally connected together via a centrally located pivoting peg 20 that allows the diagonal frame members 14, 18 to rotate relative to each other and extend as shown in FIG. 1 or collapse as shown in FIG. 5. FIG. 15 shows two diagonal members 14, 18 being connected together with a peg 20. An optional sleeve 22 is shown that provides added support.

The upper ends of the diagonal frame members 14, 18 connect to an upper corner cap 35 shown more clearly in FIG. 3. The upper ends of the two diagonal frame members 14, 18 are pivotally attached to the upper corner cap 35 with pegs 36 and allow the diagonal frame members 14, 18 to rotate in a 15 to 45 degrees arc. In the embodiment shown in FIGS. 1, 2 and 4 an optional horizontal upper frame member 40 extends between the two corner caps 35 located on opposite sides of the frame 10. Each corner cap 35 includes a receiver cavity 37 configured to receive the end of the horizontal upper frame member 40.

Figure 19:
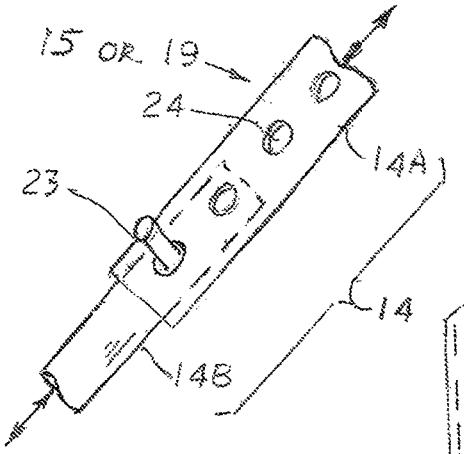
FIG. 19 is a partial side elevational view of an optional telescopic legs used in the first and second embodiments.
Figure 20:
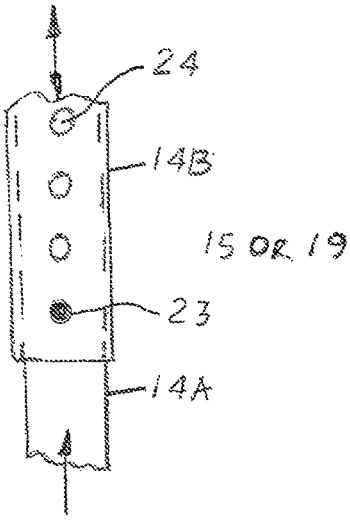
FIG. 20 is a partial side elevational view of an optional telescopic leg used in the first and second embodiments.

Each diagonal member 14, 18 is made up of two leg sections (14A, 14B, shown in FIGS. 19 and 20) that slide together to form a telescopic joint 15, 19, respectively, that enables the user to adjust the overall length of each diagonal member 14, 18. As shown in FIGS. 19 and 20 a biasing peg 23 attached to one leg section (14B) extends through one of a plurality of holes 25 longitudinally aligned on the adjoining diagonal leg section 14A. By adjusting the height of the diagonal members 14, 18, the overall height of the frame 10 may be adjusted so a child placed in the suspension seat 65 may touch the ground 90 with his feet.

The lower ends of the diagonal members 14, 18 on adjacent leg assemblies are attached to a caster wheel assembly 50. Each caster wheel assembly 50 includes a rigid, upper body 52 and a caster wheel 56. In the embodiment shown herein, each caster wheel 56 is configured to rotate 360. It should be understood that some caster wheels 56 may be aligned or locked in fixed position to control movement of the walker 8. The lower ends the diagonal members 14, 18 on adjacent leg assemblies are oriented 90 degrees apart and pivotally attached with pegs 54 to the adjacent sides of the upper body 52.

Extending horizontally between adjacent caster wheel assemblies 50 are folding four horizontal lower frame members 60. Each lower frame member 60 includes a locking, center joint 62 that enables the lower frame member 60 to be locked into an elongated, extended position to hold the caster wheel assemblies 50 apart but also allow the lower frame member 60 to be selectively unlocked and fold inward and collapse as shown in FIG. 5.

A suspension seat 65 is configured to extend over and, attached to the four upper corner members 35 as d then extend downward into the seating space 21 formed between the four leg assemblies 12, 24, 28, and 32. It should be understood, other means for attaching the seat 65 may be used. The suspension seat 65 includes two leg holes 67 that enable a child when sitting upright or standing to extend his or her legs through the leg holes 67 and touch the ground 90. During assembly, the four corners of the suspension seat 65 are wrapped around the four upper corners. When the walker includes two upper support members 40, the upper edges of the seat 65 are wrapped around the support members 40 and sewn or adhesively attached to the sides of the suspension seat 65.

FIGS. 7-12 show a second embodiment of the folding child walker 110 that includes a folding frame 112 that includes a square-shaped lower frame structure 120 with four caster wheel assemblies 140 attached at each lower corner. Walker 110 is configured to collapse vertically.

The folding frame 112 includes two X-shaped leg assemblies 122 and 126. Each leg assembly 122, 126 includes two diagonal members 130 and 134. The two diagonal members 130 and 134 are coupled together by a coupler 136. The coupler 136, shown more clearly in FIG. 11, includes two pivoting cylindrical bodies 137, 138 connected with a center peg 139. During assembly, the diagonal members 130, 134 are inserted into the cylindrical bodies 137, 138, respectively. The cylindrical bodies 137, 138 can rotate and self-adjust around each other and adjust their orientations. Optional lock screws 135 may lock the bodies 137, 138 to one or both diagonal members 130, 134.

Formed on each diagonal member 130, 134 is an optional telescopic joint 180 similar to the telescopic joint used on the first walker 10 and shown in FIGS. 19 and 20. Each diagonal member 14, 18 comprises two leg sections joined via a telescopic joint 180 respectively, that enables the user to adjust the overall length of each diagonal member 130, 134.

Figure 7:
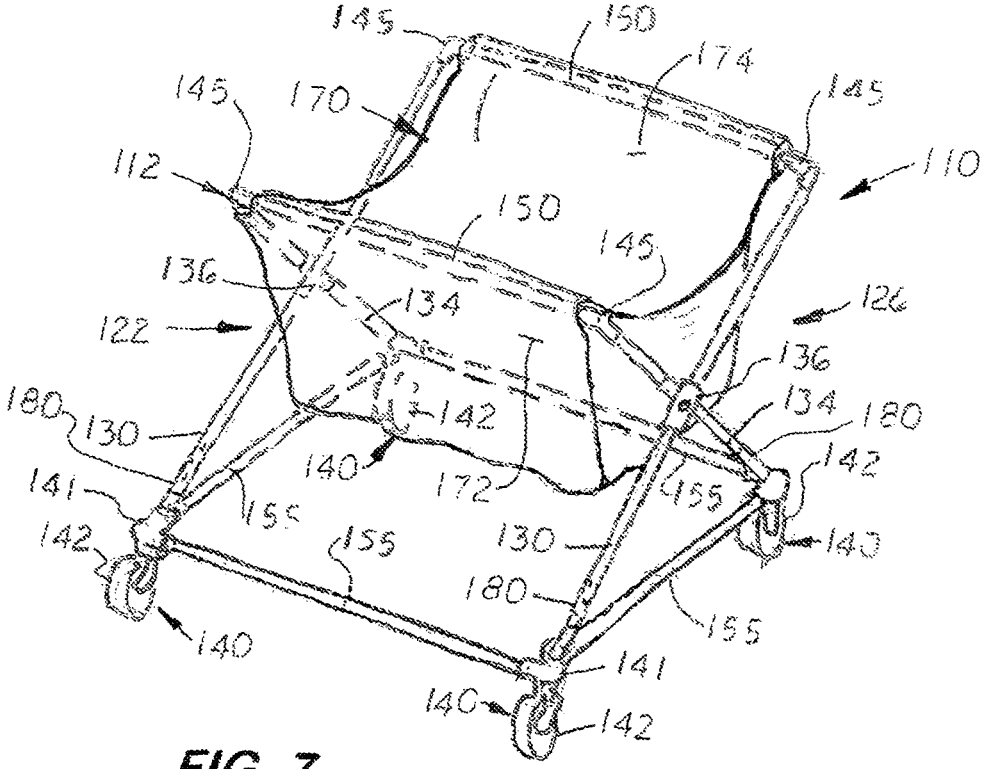
FIG. 7 is a front perspective elevational view of a second embodiment of the walker configured to collapse vertically.

Each upper end of the two diagonal members 130 and 134 is attached to an L-shaped upper corner cap 145 as shown in FIG. 7. One leg of the corner cap 145 is attached to an upper frame member 150 that extends transversely between the two leg assemblies 122, 126 and connect to the upper corner cap 145 used with the opposite leg assembly.

Figure 10:
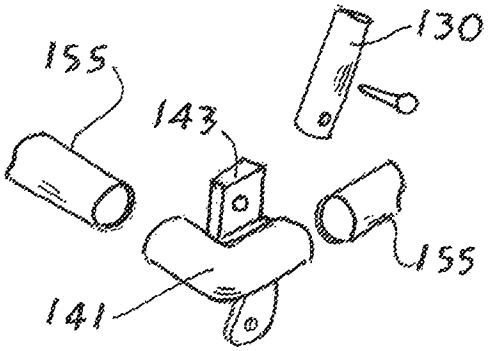
FIG. 10 is a perspective view of an L-shaped lower body that is part of the caster wheel assembly used on the second embodiment of the walker shown in FIG. 7.
Figure 12:
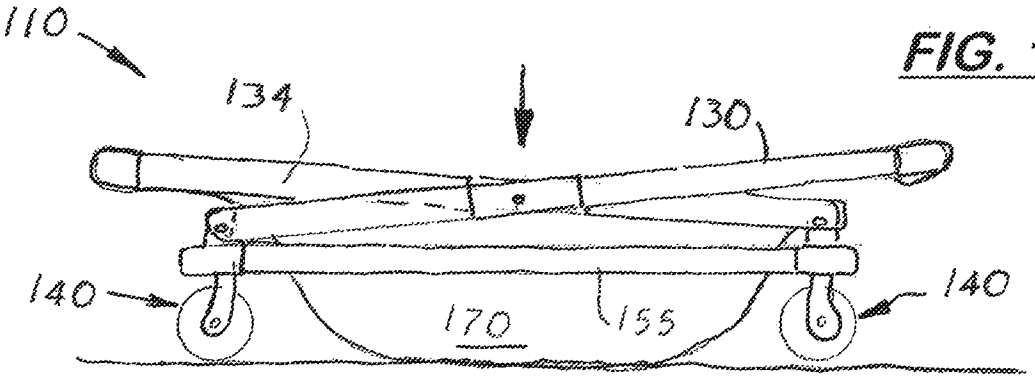
FIG. 12 is a side elevational view of the walker shown in FIG. 7 in a collapsed configuration.
Figure 14:
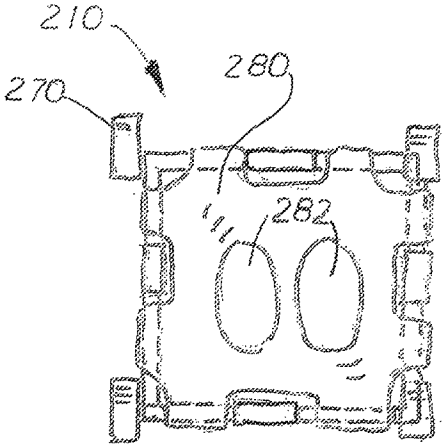
FIG. 14 is a top plan view of the walker shown in FIG. 13.
Figure 13:
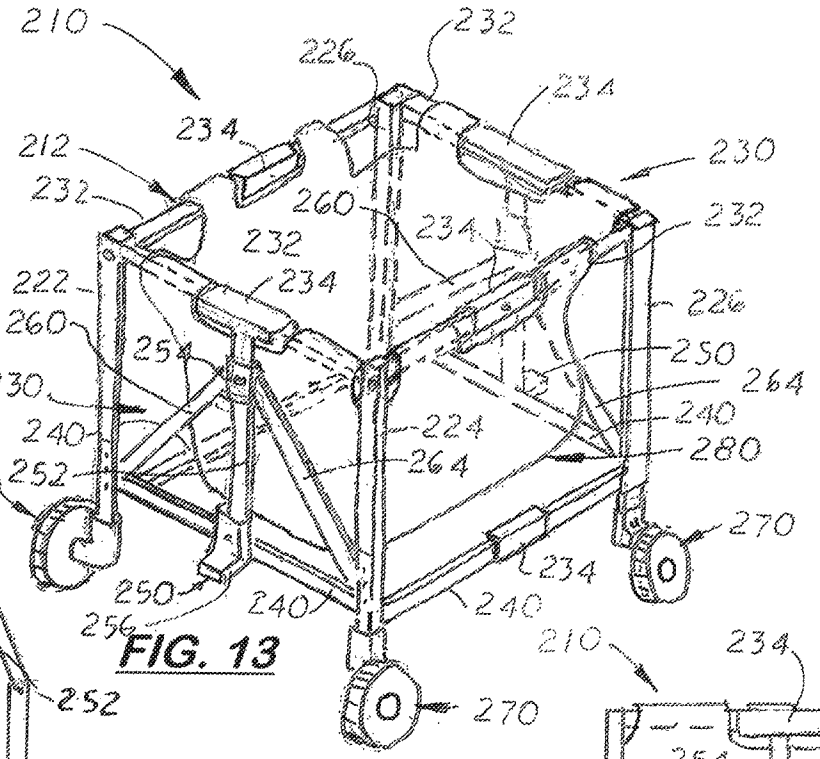
FIG. 13 a perspective view of a third embodiment of the folding child walker that includes a box style, rigid frame with four wheels attached at its four corners in an expanded configuration.
Figure 16:
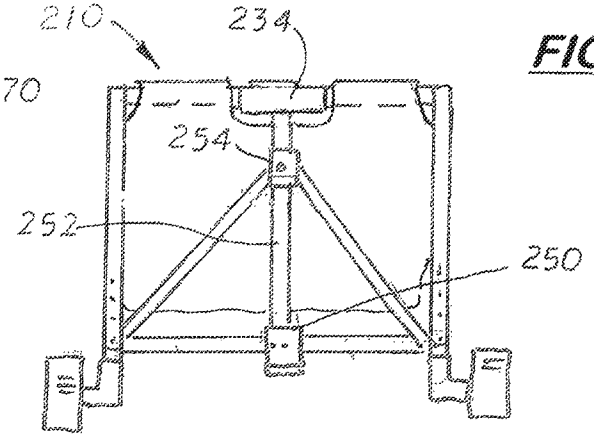
FIG. 16 is a front elevational view of the walker shown in FIG. 13.

The lower ends of the two diagonal member 130, 134 are pivotally attached to an upward stem 143 attached to a L-shaped lower body 141 as shown in FIG. 10. The lower body 141 includes two perpendicular receivers 147, 149 that connected to a horizontal lower member 155 that extends from the opposite caster wheel assemblies 140. There are four horizontal lower members 155 that keep the caster wheels assemblies 140 apart at a fixed distance.

Figure 8:
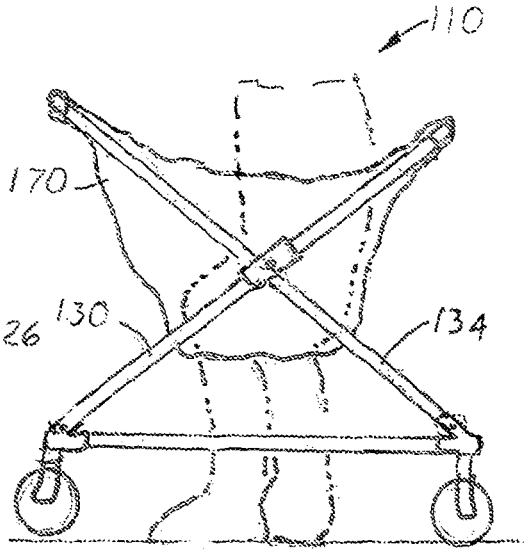
FIG. 8 is a side devotional view of the walker shown in FIG. 7.
Figure 9:
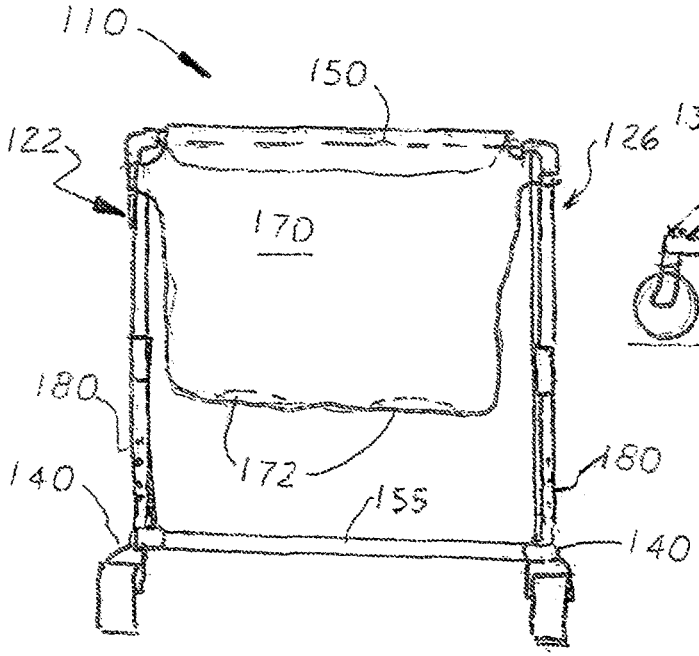
FIG. 9 is a front elevational view of the walker shown in FIG. 7
Figure 11:
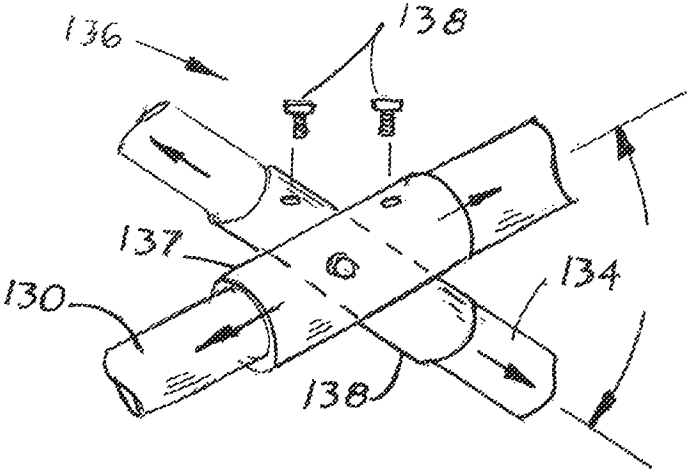
FIG. 11 is a perspective view a coupler used on the leg assemblies in the walker shown in FIG. 7.

The suspension seat 170 includes two wrap sections 172, 174 that extend around the upper frame member 150. The center portion of the seat 170 extends downward into the seating space 171 formed between the two leg assemblies 122, 126. The suspension seat 170 includes two leg holes 172 that enable the child when sitting upright to extend his or her legs through the leg holes 172 and touch the floor as shown in FIG. 8.

FIGS. 13-17 show a third embodiment of the walker 210 that includes a collapsible frame 212 with four telescopic vertical legs 222, 224, 226, and 228 and two or four collapsible side frames 230.

Each collapsing side frame 230 includes a folding upper member 232 and a folding lower member 240. The proximal ends of the folding members 232, 240 are pivotally attached to a vertical leg 222, 224, 226, 228. Each upper frame member 232 is made of two elongated sections joined by a locking collar 234 that holds distal ends of the elongated sections together in axial alignment. The locking collar 234 is pivotally attached at its opposite ends to the two elongated sections. When the locking collar 234 is forced upward, the two elongated sections are misaligned thereby enabling the legs 222, 224, 226 or 228 to move inward as shown in FIG. 15. On the front and rear side frames on the walker 210, a supplemental locking assembly 250 is provided that locks the child walker in an expanded, unfolded configuration. Each supplemental locking assembly 250 includes a vertical bar 252 a locking plate 254, and a foot pedal 256. The locking plate 254 is attached to two diagonal members 260, 264 that are pivotally attached at their lower ends to the corners. The locking plate 254 is affixed to the vertical bar 252 that extends between the upper frame member 232 and the lower frame member 240. In the embodiment shown in FIGS. 4-7, the supplemental locking assembly 250 is attached to the front and rear side frames. It should be understood that ogre side or all four side frames may include a supplemental locking assembly 250.

Attached to the end of each legs 222, 224, 226, and 228 is a caster wheel 270.

Like the first and second embodiments of the walker 10 and 110, a suspension seat 280 is attached to the legs 222, 224, 226, and 228 and extend downward into the seating space 213 for formed between the four legs 22, 224, 226, and 228. The suspension seat 280 includes two leg holes 282 that enable the child when sitting upright to extend his or her legs through the leg holes 282 and touch the ground.

When unfolded, the supplemental locking assembly 250 is locked. In order to fold the walker 210, the supplemental locking assembly 250 must be unlocked. When unlocked, the locking collars on the upper frame member 232 and lower frame member 240 are lifted causing the walker 210 to collapse as shown in FIG. 15.

In the preferred embodiment, each vertical leg 222, 224, 226, and 228 is made up of two leg sections telescopically connected together similar to the manner shown in FIGS. 19 and 20 enabling the leg 222, 224, 226, and 228 to be adjusted in length to accommodate the different heights of a child using the walker.

In compliance with the statute, the invention described has been described in language more or less specific as to structural features it should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A child's walker, comprising:

a. a frame that includes four telescopic legs and four, vertically aligned, collapsing side frames surrounding a sitting area, each said side frame includes a folding upper member and a folding lower member;

b. a locking collar attached to each said upper member and said lower member configured to selectively lock said upper member and said lower member in a straight alignment and hold said legs apart c. at least two supplemental locking assembly located on opposite sides of said frame configured to lock said frame in an expanded, unfolded configuration;

d. a caster wheel assembly attached to a lower end of each said leg; and e. a suspended seat attached to said frame and extending into said sitting area, said seat includes two leg holes.

2. The child's walker as recited in claim 1, wherein said supplemental locking assembly includes a vertical bar, a locking plate configured to slide along said vertical bar, and two diagonal members pivotally attached at one end of said locking bar and pivotally attached at an opposite end to a vertical leg.

* * * * *